United States Patent [19]

Hlavaty

[11] Patent Number: 4,798,070

[45] Date of Patent: Jan. 17, 1989

[54] COMBINED THREAD ROLLING DIES

[75] Inventor: Robert J. Hlavaty, Avon Lake, Ohio

[73] Assignee: Colt Industries Operating Corporation, W. Hartford, Conn.

[21] Appl. No.: 509,932

[22] Filed: Jul. 1, 1983

[51] Int. Cl.[4] ..... B21H 3/06

[52] U.S. Cl. ..... 72/88

[58] Field of Search ..... 72/90, 88, 469

[56] References Cited

U.S. PATENT DOCUMENTS

| | | | |
|---|---|---|---|
| 236,085 | 12/1880 | Reynolds | 72/88 |
| 387,184 | 7/1888 | Rogers | 72/71 |
| 1,232,875 | 7/1917 | Wilcox | 72/31 |
| 1,748,503 | 2/1930 | Wayne | 72/90 |
| 1,972,225 | 9/1934 | Hogue | 72/90 |
| 1,979,919 | 11/1934 | Wayne | 72/90 |
| 2,314,391 | 3/1943 | DeVellier | 10/9 |
| 2,336,190 | 12/1943 | Richards | 72/469 |
| 2,596,962 | 5/1952 | Stern | 72/90 |
| 2,672,774 | 3/1954 | Stern | 72/90 |
| 2,825,251 | 3/1958 | Rader | 72/90 |
| 2,859,647 | 11/1958 | Nielsen | 72/90 |
| 3,076,358 | 2/1963 | Paper et al. | 72/90 |
| 3,260,100 | 7/1966 | Wieber | 72/88 |
| 3,517,542 | 6/1970 | Skierski | 72/469 |
| 4,136,416 | 1/1979 | Thomas | 72/469 |
| 4,206,535 | 6/1980 | Roth | 72/88 |

FOREIGN PATENT DOCUMENTS

| | | | |
|---|---|---|---|
| 294822 | 5/1914 | Fed. Rep. of Germany | 72/469 |

*Primary Examiner*—Daniel C. Crane

*Attorney, Agent, or Firm*—Pearne, Gordon, McCoy & Granger

[57] ABSTRACT

A die set consisting of three separate dies is disclosed, with the first die having thread forming ridges on both sides thereof and both sides being flat, i.e., the contact surface areas thereof lying in a single plane to engage a flat, planar die support surface in the die holder. Each of the second and third dies is a single-face die with a flat, planar rear face to engage the die holder, and the working face of each of the second and third dies includes a longitudinally tapered portion and a parallel dwell portion for final finishing of the workpiece. This effectively doubles the die life for only a fifty percent increase in die material. The foregoing abstract is merely a resume of one general application, is not a complete discussion of all principles of operation or applications, and is not to be construed as a limitation on the scope of the claimed subject matter.

7 Claims, 1 Drawing Sheet

COMBINED THREAD ROLLING DIES

BACKGROUND OF THE INVENTION

U.S. Pat. No. 387,184 shows that in 1888 it was known to utilize two relatively longitudinally reciprocating flat dies, each with a tapered portion to gradually begin the thread rolling and then each with a dwell portion which was parallel to the longitudinal direction of movement which completed the thread rolling and gave a finish form to the threads. This type of machine is still used today wherein there is no provision for tilt of the dies or the die holders in a longitudinal direction, and it is intended that the dwell portion shall be parallel to the longitudinal relative direction of movement of the die holders in order to provide the finish form rolling to the threads.

The German Pat. No. 294,822 showed that in 1914 it was known to use reversible dies. Machinists had learned between 1888 and 1914 that if one were going to the expense of heat treating the dies and then shipping and selling them to a customer, the customer might as well get double life from the die by having it reversible face-to-face and using the second die face for a threading operation. However, because of the high forces encountered in the thread rolling, the dies need to be backed by a supporting surface in the die holder, so in this second type of machine the die holder pockets are somehow adjustable for tilt in a longitudinal direction. This is so that the thread rolling on the workpiece is gradually increased from the entrance end to the exit end. However, this type of tilt-adjustable die holder pocket has the disadvantage that the flat contact surface of the die ridges which form the threads on a workpiece cannot have any parallel dwell portion for precisely finishing the thread form.

U.S. Pat. No. 1,232,876 shows a different form of reversible die, being reversible end-for-end rather than face-to-face, because the length of the workpiece is far shorter than the width of the die, so the die can be made to accommodate thread forms to roll form workpieces of two different lengths.

U.S. Pat. No. 1,972,225 is a 1934 patent which acknowledges it was customary to make the thread rolling dies reversible, and shows them reversible face-to-face. These are relatively thick dies which will withstand the force of the thread rolling, and in order to make the dies reversible and yet the thread ridges on the back face of the die supported in the die holder, the second type of machine would be used wherein the entire die pocket would be tilted longitudinally relative to the longitudinal direction of movement.

Other patents such as U.S. Pat. No. 2,314,391 appear to show the die pockets parallel to the direction of movement, with the thread rolling face of the die at a slight angle to the longitudinal direction of movement.

U.S. Pat. No. 2,825,251 illustrates the first type of machine wherein the die pockets are parallel to the direction of movement yet each thread forming face in the die has a tapered portion and a parallel dwell portion.

The issued patents support the practice in the industry, namely, that since at least 1888 it has been known to use die holders which are not adjustable for longitudinal tilt, with both dies having a tapered portion and a parallel dwell portion for finishing the thread forms. It has been known since at least 1914 to increase the effective die life by making the dies reversible face-to-face, but in order to support the die against the high forces of thread rolling, the reversible die contact surface was necessarily flat to engage a flat planar surface in the die holder pocket, and then the entire die holder pocket was tiltable longitudinally.

This means that the depth of penetration of the thread rolling action continues completely to the very end of the movable die. There is often a very short tapered roll-off portion to prevent marking the threaded workpiece; however, without any parallel-to-motion dwell portion, the threaded workpiece is often slightly oval in form in order to have enough rolling pressure to get the crests of the thread forms completely filled out. With this ovaliform cross section to the workpiece, it is more difficult to keep the workpieces within specification as to minimum and maximum diameters, and as a result more time is spent in keeping the machine in proper adjustment in order to produce workpieces within specification.

SUMMARY OF THE INVENTION

Accordingly, the problem to be solved is how to produce a die set for a thread rolling machine which will effectively increase the die life of the die set, yet produce threaded workpieces of round cross section which are within specification for a greater run of workpieces.

This problem is solved by a thread rolling die set comprising, in combination, a first die having first and second opposed faces, thread forming ridges on said first face having the crests thereof lying parallel to said second face, a second die having first and second opposed faces with said second face being a flat plane adapted to engage a die holder which is nonadjustable as to tilt, said second die first face having thread forming ridges thereon with the crests of a first longitudinally tapered portion thereof being at a slight angle to said second die second face and with the crests of a second longitudinal dwell portion thereof being parallel to said second die second face, said first faces of said first and second dies being a die pair to roll a thread on a workpiece, said second face of said first die including thread forming ridges the crests of which lie parallel to said first die first face, a third die having first and second opposed faces with said second face being a flat plane and with said third die first face having thread forming ridges thereon with the crests of a first longitudinally tapered portion thereof being at a slight angle to said third die second face and with the crests of a second longitudinal dwell portion thereof being parallel to said third die second face, and said third die first face adapted to cooperate with said first die second face as a die pair to roll threads on a workpiece.

The problem is further solved by a thread rolling die set including first and second flat dies relatively longitudinally movable and each having first and second opposed faces, thread forming ridges on both faces of the first die and on the first face of the second die, the provision of the second face of the second die being a flat plane adapted to engage a flat support surface in a die holder, said second face on said first die having the contact surface area thereof in a flat plane throughout the entire length thereof adapted to engage a flat planar surface in the respective die holder, said first face of said second die having thread forming ridges thereon with the crests of a first longitudinal portion thereof being at a slight angle to said second die second face and with the crests of a second longitudinal portion thereof being parallel to said second die second face, said first face of said second die cooperable with said first face of said first die as a die pair to roll threads on a workpiece, a third die having first and second opposed faces with said second face being a flat plane to engage a die holder and with said third die first face having thread forming ridges thereon with the crests of a first longitudinal portion thereof being at a slight angle to said third die second face and with the crests of a second longitudinal portion thereof being parallel to said third die second face, and said third die first face adapted to cooperate with said first die second face as a die pair to roll threads on a workpiece.

The problem is further solved by a thread rolling machine having a first die holder and a second movable die holder each of which is non-adjustable for tilt of the die therein relative to the longitudinal direction of movement of the movable die holder, first and second dies each with first and second opposed faces, a die support surface in each of said die holders adapted to engage the respective die second face, thread forming ridges on said first die first face having the crests thereof lying parallel to said second face thereof and with said second face being in flat engagement with said first die holder support surface, said second face of said second die having the contact surface area thereof in a flat plane engaged against said second die holder support surface, said second die first face having thread forming ridges thereon with the crests of a first longitudinal portion thereof being at a slight angle to said second die second face and with the crests of a second longitudinal portion thereof being parallel to said second die second face, and said die support surfaces being flat planar surfaces to engage the respective die second faces and resist the thread rolling force throughout the entire length of the respective die.

Accordingly, an object of the invention is to provide a reversible die which has contact surfaces on both faces which are flat throughout the length thereof, which die will cooperate with a single-faced die having a tapered portion and a parallel dwell portion.

Another object of the invention is to provide a die set consisting of three dies one of which is double-faced and the other two of which are single-faced.

Another object of the invention is to provide a die set consisting of three dies, one of which is double-faced longitudinally split and the other two of which are single-faced longitudinally split, for four different die set combinations.

Other objects and a fuller understanding of the invention may be had by referring to the following description and claims, taken in conjunction with the accompanying drawings.

DESCRIPTION OF THE PREFERRED EMBODIMENTS

Figure 1A:
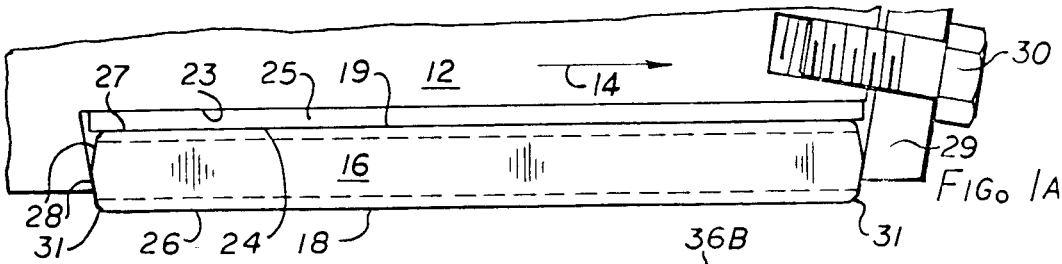
FIG. 1A is a plan view of a part of a die holder and a reversible die therein utilizing the invention.
Figure 1B:
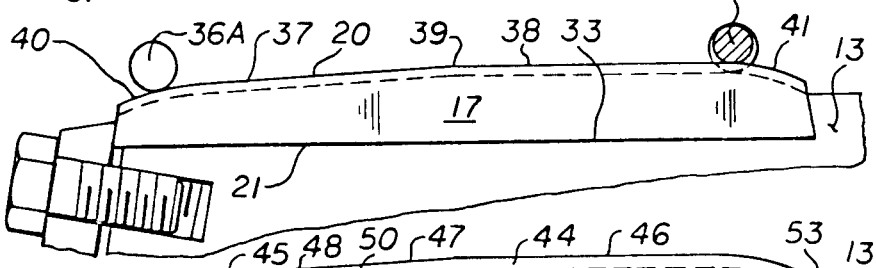
FIG. 1B is a plan view of a part of a die holder and a single-faced die therein cooperable with the die of FIG. 1A to roll threads on a workpiece.
Figure 1C:
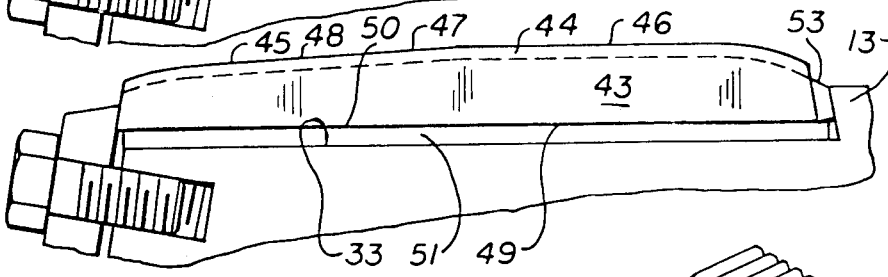
FIG. 1C is a plan view of a third die cooperable with the rear face of the die of FIG. 1A to roll threads on a workpiece.
Figure 2A:
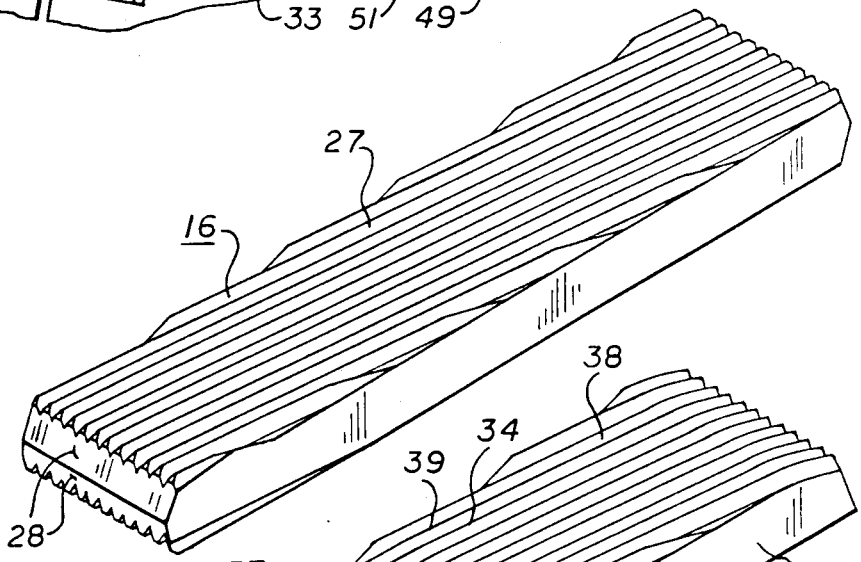
FIG. 2A is an isometric view of the reversible die of FIG. 1A.
Figure 2B:
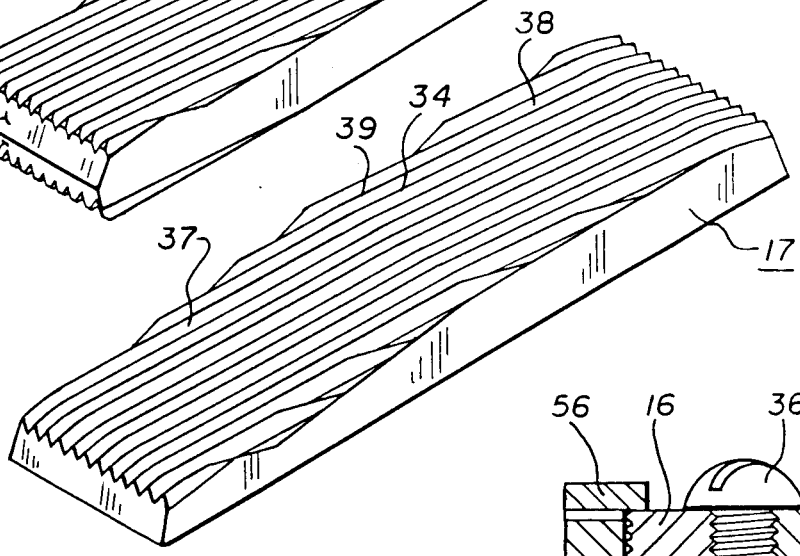
FIG. 2B is an isometric view of the single-faced die of FIG. 1B.
Figure 3:
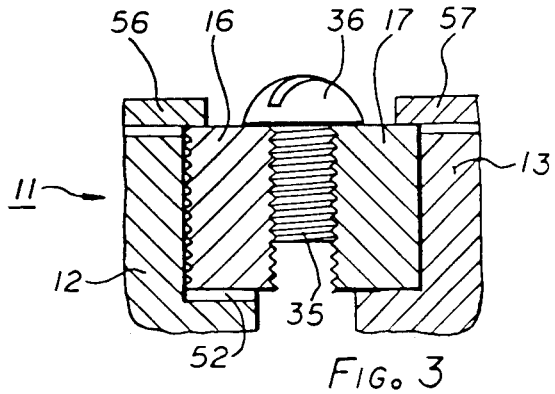
FIG. 3 is a sectional view showing part of two die holders and the two dies, and showing the action of threading a workpiece.

FIG. 3 illustrates rather schematically a thread rolling machine 11 having first and second die holders 12 and 13 which are relatively longitudinally movable perpendicular to the plane of the paper in FIG. 3. These die holders 12 and 13 are shown in FIGS. 1A and 1B, respectively. Each may be movable longitudinally, but in the usual machine construction only the die holder 12 is longitudinally reciprocable and is movable in the direction of the arrow 14 during the thread rolling half of the reciprocating cycle. The first die holder is adapted to mount a first die 16 and the second die holder 13 is adapted to mount a second die 17. The first die 16 has first and second opposed faces 18 and 19, respectively, and the second die 17 has first and second opposed faces 20 and 21, respectively. The first die holder 12 has a die support surface 23 defining a pocket to receive the first die 16. As shown in FIG. 1A, a secondary die support surface 24 is provided by a parallel-faced shim 25, which may optionally by used. The first die 16 has two flat sides, i.e., the reversible faces of the die 16 which may engage the die support surface 23 or 24 are faces which have the contact surface area thereof in a flat plane throughout the entire length thereof. The die support surface 23 and the secondary die support surface 24 are flat planar surfaces to fully engage the contact surface area of the die 16 throughout the length thereof. There are thread forming ridges 26 on the first face 18 and thread forming ridges 27 on the second face 19 of this first die 16. This makes it a reversible die. In order to make it reversible and still mountable in the first die holder 12, each end of the die 16 has a double bevel 28 so that one end fits against the end of the pocket in the die holder 12 and the other end is secured by some form of a clamp, shown as a clamp 29 and machine screw 30. In accordance with good machining practice, the sharp corners at the ends of the thread forming ridges on the first die 16 may be beveled or rounded, as at 31.

The second die 17 is a single-faced die rather than a reversible die, namely, the second face 21 thereof is a flat, planar face to engage a die support surface 33 in the second die holder 13. Again, this may be a support surface unitary with the die holder, or a secondary die support surface on a parallel-faced shim. The first face 20 of the second die 17 has thread forming ridges 34 thereon which match the thread forming ridges 26 on the first face of the die 16 in order to be able to cooperate therewith to roll threads 35 on a work-piece 36. A workpiece blank 36A is shown in FIG. 1B at the entrance end of the die 17, and this would be in cooperation with the right end or entrance end of die 16 of FIG. 1A. Also, FIG. 1B shows a completed threaded workpiece 36B at the right or exit end of the die 17, and this would be as cooperating with the exit end or left end of the die 16.

The thread forming ridges 34 have two main longitudinal portions, a longitudinally tapered portion 37 and a parallel dwell portion 38 merging at about the line 39. A short, tapering roll-on portion 40 is usually provided at the entrance end of the die 17 and a short tapering roll-off portion 41 is usually provided on the exit end of the die 17.

A third die 43 completes the set of first, second, and third dies for use in the thread rolling machine 11. This third die 43 is preferably identical to the second die 17, and the thread forming ridges 44 thereon have a longitudinally tapered portion 45 and a parallel dwell portion 46 merging at a line 47. The thread forming ridges 44 are on a first face 48 of the third die 43 and a second opposed face 49 is a flat, planar face to engage and be supported by a die support surface 50, which in this case is an optional parallelfaced shim 51 engaging the primary die support surface 33 of the second die holder 13.

In accordance with customary thread rolling practice, the parallel-faced shims 25 or 51 may be used to adjust the position of the dies so as to obtain complete formation of the crests of the threads 35 on the workpiece 36 for a given diameter of workpiece blank. Also, optional parallel-faced shims 52 have been known and used for adjusting the vertical height of one die for thread form matching between the two dies 16 and 17. Also, optional parallel-faced shims 53 have been known and used at the ends of one or both dies to adjust the relative longitudinal starting position of the dies for thread form matching. FIG. 3 shows, rather schematically, the first and second die holders 12 and 13, and clamps 56 and 57 are used to secure the dies 16 and 17 in the vertical direction in the die pockets of these die holders.

The single-faced dies 17 and 43 have ends with only a single bevel, to match the bevel in the corresponding die pocket, for positive clamping therein. As shown in FIGS. 1A and 1B, the flat-faced first die 16 has a length longer than the second die 17 with the longitudinally tapered portion 37. This is so that the initial contact of the workpiece blank 36A will not be at the extreme right end or entrance end of this first die 16, but will be spaced slightly inwardly from this extreme end. Also, as the finished roll-formed workpiece 36B leaves the second die 17 at the tapered roll-off portion 41, it will also leave contact at the left or exit end of the first die 16 before it comes to the extreme end of this die 16.

OPERATION

The first and second dies 16 and 17 are adapted to cooperate to roll the threads 35 on a workpiece 36. In order to perform this, these two dies are mounted in the die holders 12 and 13, respectively, wherein the die support surfaces 23 and 33 are parallel to the longitudinal direction of relative movement of the dies. Both dies may be longitudinally movable, although in the usual type of thread rolling machine 11, the die holder 13 is fixed and the die holder 12 is the only one which is movable. The first die 16 has the first face 18 as the operative face to operate on the workpiece 36, and the second face 19 has a surface contact area which is flat throughout the entire length of this die 16, with the immaterial length difference caused by the beveled ends 28 and the rounded corners 31. This rear face 19, as mounted, is fully supported by the die support surface 23, or 24 if the shim 25 is used. It is fully supported throughout the entire length of the die 16 in order to resist the high thread rolling forces generated during the thread forming operation. The thread forming ridges 27 have the same shape as the thread forming ridges 34 on the die 17, in order to roll form the threads 35. All of the longitudinal taper is built into the second die 17 at the longitudinally tapered portion 37, and there is no longitudinal taper on the first die 16. This is in distinction to the prior art form wherein the longitudinal taper was built into each of the two dies of the die pair.

As the workpiece blank 36A is gradually rolled, the metal is extruded, primarily into the crests of the threads 35. As the workpiece is being rolled, it is actually forced into an oval shape, and the purpose of the parallel dwell portion 38 is to roll form the workpiece 36 after the threads are full depth to finish the threads and to reshape the part into a round cross-sectional shape rather than an oval shape. To accomplish this, the parallel dwell portion is long enough to accommodate at least one complete revolution of the workpiece for this final finishing operation just before the tapered roll-off portion 41 is reached. Such tapered or radial roll-off portion prevents marking of the threads on the finished workpiece due to abrupt release of the thread rolling force. The parallel dwell portion 38 may be sufficiently long to provide two or three complete revolutions to the workpiece 36, and in FIG. 1B, this parallel dwell portion 38 has been shown in this elongated form. Often, such parallel dwell portion is considerably shorter than the tapered portion 37, especially where a long, longitudinally tapered portion is required in order to gradually increase the depth of penetration of the ridges 26 and 34 into the workpiece blank. This longitudinally tapered portion 37 may be cross-serrated or otherwise roughened to help assure that the workpiece 36 will have a rolling contact rather than a sliding contact with the dies 16 and 17.

When the die pair, comprising the die faces 18 and 20, become worn and unusable due to forming threads which are out of specification, this die pair need not be discarded. Instead, the die 16 may be reversed face-to-face, and the second face 19 may be used in cooperation with the first face 48 of the third die 43. This will constitute a new die pair for rolling additional workpieces. It is usual that the thread form on the first die faces 18 and 19 will be identical, although this is not necessary for the performance of this invention. All that is necessary is that the thread forming ridges on the faces 18 and 20 match each other and that the thread forming ridges on the die faces 19 and 48 match each other. Also, it will be possible to add fourth and fifth dies to the total die set, these dies again being substantially indentical to the dies 17 and 43. These fourth and fifth dies could be used where the length of the threaded workpiece is less than half the width of the firt die 16. In such case, the wear on the dies is only on the upper half thereof, as shown in FIG. 3, and the die 16 in FIG. 1A may be turned end-for-end about an axis lying in the plane of the paper of FIG. 1A, in order to utilize the lower half of this same first die face 18 in conjunction with the fourth die. The fifth die would be used in conjunction with the lower half of the die face 19. The dies 17 and 43 may be reversed end-for-end where short workpieces for the width of the dies are being rolled. The dies 17 and 43 could then have a face longitudinally split so as to have the longitudinally tapered and parallel dwell portions on each longitudinal half of the two faces. This would permit one double-faced reversible die 16 and two single-faced dies 17 and 43, all with split faces, for four die set combinations.

By utilizing the three dies 16, 17, and 43 in the complete die set, it is possible to effectively double the useful die life yet to have a die set which eliminates the ovaliform workpiece found in many of the prior art constructions which utilize two flat-faced dies with one at a slight angle to the direction of longitudinally reciprocating movement. Even though such prior art dies had a short tapered roll-off portion to eliminate the marking of the threads of the workpiece, they often did not achieve nicely finished workpieces because they were ovaliform, a result of the high rolling pressures at the very end of thread rolling operation. The present invention eliminates this defect, and also effectively increases the die life.

The dies 16 and 17 are termed "thin dies" in relation to their length, e.g., being only about ⅝ inch thick for a length of about six inches, and are intended for use in a particular type of thread rolling machine widely used in the United States, namely one which has die holders and die pockets which are non-adjustable for longitudinal tilt. The term "thin dies" in relation to their length is also related to the size of the machine with which used, the size denoting generally the maximum diameter of the threads on the workpiece, per the following table:

| Machine size | Thickness of Die |
|---|---|
| 3/16" | ½" |
| ¼, 5/16 & ⅜" | ⅝" |
| ½" | 13/16" |
| ⅝" | ⅞" |
| ¾" | 1" |
| 1" | 1¼" |
| 1¼" | 1⅝". |

The die support surfaces 23 and 33 are parallel to the longitudinal direction of reciprocable movement, and because of the relative thinness of these dies, it is necessary to back them completely along the length thereof by the flat, planar die support surface 23 or 33. In fact, it has been known that the high rolling forces cause the hardened die ridges on the die face 19 to slightly embed themselves in the die support surface 24 of the shim 25, so that it is often necessary, after a first production run, to re-shim the thread rolling machine 11 in order to have the workpieces 36 within specification. It is not economically practicable to make the second die 17 double-faced because than one would not have continuous support throughout the length of the die, and the die would rock in the die pocket about the merge line 39 during the thread rolling operation. This would not be permissible as a practical matter.

The present invention effectively doubles the die life of the complete die set with only a fifty percent increase in the die material. Also, there is only a fifty percent increase in the die weight for shipping, handling, and storage requirements for the customer.

The present disclosure includes that contained in the appended claims, as well as that of the foregoing description. Although this invention has been described in its preferred form with a certain degree of particularity, it is understood that the present disclosure of the preferred form has been made only by way of example and the numerous changes in the details of construction and the combination and arrangement of parts may be resorted to without departing from the spirit and the scope of the invention as hereinafter claimed.

What is claimed is:

1. A thread rolling die set consisting of only first, second, and third dies for use in a thread rolling machine having only a single pair of dies therein at any one time to roll threads on a workpiece, comprising, in combination:

said first die having first and second opposed faces, thread forming ridges on said first face having the crest thereof lying parallel to said second face;

said second die having first and second opposed faces with said second face being a flat plane adapted to engage a die holder in the thread rolling machine which is non-adjustable as to tilt;

said second die first face having thread forming ridges thereon with the crests of a first longitudinally tapered portion thereof being at a slight angle to said second die second face and with the crests of a second longitudinal dwell portion thereof being parallel to said second die second face, said first faces of said first and second dies cooperating to roll threads on a workpiece when said first and second dies are mounted in a thread rolling meachine;

said second face of said first die including thread forming ridges the crests of which lie parallel to said first die first face;

said third die having first and second opposed faces with said second face being a flat plane and with said third die first face having thread forming ridges thereon with the crests of a first longitudinally tapered portion thereof being at a slight angle to said third die second face and with the crests of a second longitudinal dwell portion thereof being parallel to said third die second face, said first die being reversible face-to-face in the thread rolling machine and said second die being removable from the machine;

said first face of said third die cooperating with said second face of said first die to roll threads on a workpiece when said first and third dies are mounted in a thread rolling machine.

2. A thread rolling die set as set forth in claim 1, wherein each of said dies is relatively thin and requires solid support throughout substantially the entire length thereof in order to withstand the force of thread rolling.

3. A thread rolling die set as set forth in claim 1, wherein each of said dies is in the order of only ⅝ inch thick for a length of about six inches and requires substantially continuous support along the second face thereof to withstand the force of thread rolling.

4. A die set as set forth in claim 1, wherein said first die is longer than said second die; and roll-on and roll-off portions at the beginning and end areas of said second die first face which areas are tapered relative to said second die second face in order to gradually commence the thread rolling and gradually terminate thread rolling on a workpiece while still in rolling engagement with said first die first face.

5. A die set as set forth in claim 1, wherein said second die has ends thereof beveled in only a single direction for clamping in a die pocket and said first die has ends thereof beveled in two directions for reversible clamping in a die pocket.

6. In a thread rolling die set consisting of only first, second and third flat dies for use in a thread rolling machine having only a single pair of dies therein at any one time to roll threads on a workpiece, including said first and second flat dies being relatively longitudinally movable and each having first and second opposed faces, thread forming ridges on both faces of the first die and on the first face of the second die;

the provision of the second face of the second die being a flat plane adapted to engage a flat support surface in a die holder in the thread rolling machine;

said second face on said first die having the contact surface area thereof in a flat plane throughout the entire length thereof adapted to engage a flat planar surface in the respective die holder in the thread rolling machine;

said first face of said second die having thread forming ridges thereon with the crests of a first longitudinal portion thereof being at a slight angle to said second die second face and with the crests of a second longitudinal portion thereof being parallel to said second die second face, said first face of said second die and said first face of said first die cooperating to roll threads on a workpiece when said first and second dies are mounted in a thread rolling machine;

said first die being reversible face-to-face in the thread rolling machine and said second die being removable from said die holder in the machine;

said third die being selectively mountable in said die holder in the machine with said third die having first and second opposed faces with said second face being a flat plane to engage said die holder in the thread rolling machine and with said third die first face having thread forming ridges thereon with the crests of a first longitudinal portion thereof being at a slight angle to said third die second face and with the crests of a second longitudinal portion thereof being parallel to said third die second face; and said third die first face and said first die second face cooperating to roll threads on a workpiece when said first and third dies are mounted in a thread rolling machine.

7. A thread rolling machine having a first die holder and a second movable die holder each of which is non-adjustable for tilt of the die therein relative to the longitudinal direction of movement of the movable die holder;

first and second dies each with first and second opposed faces;

a die support surface in each of said die holders adapted to engage the respective die second face;

thread forming ridges on said first die first face having the crests thereof lying parallel to said second face thereof and with said second face being in flat engagement with said first die holder support surface when said first die is mounted in said first die holder.

said second face of said second die having the contact surface area thereof in a flat plane engaged against said second die holder support surface when said second die is mounted in said second die holder;

said second die first face having thread forming ridges thereon with the crests of a first longitudinal portion thereof being at a slight angle to said second die second face and with the crests of a second longitudinal portion thereof being parallel to said second die second face;

said die support surfaces being flat planar surfaces to engage the respective die second faces and resist the thread rolling force throughout the entire length of the respective die;

said second face of said first die including thread forming ridges the crests of which lie parallel to said first die first face to be supported along the full length thereof by said die support surface in said first die holder;

a third die having first and second faces with said second face being a flat plane supported along the full length thereof by said die support surface in said second die holder when said third die is mounted in said machine and with said third die first face having thread forming ridges thereon with the crests of a first longitudinal portion thereof being at a slight angle to said third die second face and with the crests of the second longitudinal portion thereof being parallel to said third die second face;

said first faces of said first and second dies cooperating to roll threads on a workpiece when said first and second dies are mounted in said machine; and said third die first face and said first die second face cooperating to roll threads on a workpiece when said first and third dies are mounted in said machine.

* * * * *